US005533692A

United States Patent [19]

Layton

[11] Patent Number: 5,533,692

[45] Date of Patent: Jul. 9, 1996

[54] BEAMRIDER GUIDANCE SYSTEM USING DIGITAL PHASE MODULATION ENCODING

[75] Inventor: Allen C. Layton, Winter Garden, Fla.

[73] Assignee: Oerlikon-Contraves AG, Zurich, Switzerland

[21] Appl. No.: 316,151

[22] Filed: Oct. 28, 1981

Related U.S. Application Data

[63] Continuation-in-part of Ser. No. 7,751, Jan. 30, 1979, Pat. No. 4,299,360.

[51] Int. Cl.[6] ..... F41G 7/24

[52] U.S. Cl. ..... 244/3.13

[58] Field of Search ..... 244/3.13

[56] References Cited

U.S. PATENT DOCUMENTS

| | | | |
|---|---|---|---|
| 2,404,942 | 7/1947 | Bedford | 244/3.13 |
| 2,659,828 | 11/1953 | Elliott | 244/3.13 |
| 3,255,984 | 6/1966 | Hawes | 244/3.13 |
| 3,398,918 | 8/1968 | Girault | 244/3.13 |
| 3,501,113 | 8/1970 | Maclusky | 244/3.13 |
| 3,690,594 | 9/1972 | Menke | 244/3.13 |
| 3,782,667 | 1/1974 | Miller, Jr. et al. | 244/3.13 |
| 4,014,482 | 3/1977 | Esker et al. | 244/3.13 |
| 4,174,818 | 11/1979 | Glenn | 244/3.13 |
| 4,186,899 | 2/1980 | Stowart, Jr. | 244/3.13 |

*Primary Examiner*—Charles T. Jordan
*Assistant Examiner*—Theresa M. Wesson
*Attorney, Agent, or Firm*—Sandler, Greenblum & Bernstein

[57] ABSTRACT

A beam of electromagnetic radiation is spatially encoded using a digital phase modulation technique. The spatial encoding defines the beam cross section into a series of resolution elements each identified by a different digital code. The codes defining resolution elements are detectable by a missile located in the radiation beam and can be used to define the location of the missile in this beam. In the preferred embodiment, an encoding mask, moved through the beam at its source, provides the digital phase modulation. The mask is provided with a series of bit areas, each of which bears at least two sets of cyclically recurring bands effective to modulate a detectable parameter of the radiation, such as intensity. The spacing between adjacent bands of a set, termed a bit cycle, is proportional to a predetermined phase of the modulation of the beam parameter. The novel arrangement enables the missile to identify its position within the beam under conditions of severe atmospheric turbulence and object induced perturbations to provide corrective maneuvers for maintaining the missile velocity vector aligned with the beam.

22 Claims, 3 Drawing Sheets

| DIGITAL CODE | ELEVATION BEAM POSITION | AZIMUTH BEAM POSITION |
|---|---|---|
| 1100 | 8T | 8R |
| 1101 | 7T | 7R |
| 1111 | 6T | 6R |
| 1110 | 5T | 5R |
| 1010 | 4T | 4R |
| 1011 | 3T | 3R |
| 1001 | 2T | 2R |
| 1000 | 1T | 1R |
| 0000 | 1B | 1L |
| 0001 | 2B | 2L |
| 0011 | 3B | 3L |
| 0010 | 4B | 4L |
| 0110 | 5B | 5L |
| 0111 | 6B | 6L |
| 0101 | 7B | 7L |
| 0100 | 8B | 8L |

BEAMRIDER GUIDANCE SYSTEM USING DIGITAL PHASE MODULATION ENCODING

This is a continuation-in-part of application Ser. No. 7,751, filed Jan. 30, 1979, now U.S. Pat. No. 4,299,360.

BACKGROUND OF THE INVENTION

1. Field of the Invention

The invention relates to apparatus for producing an electromagnetic beam in space having spatial encoding thereof and more particularly to missile guidance systems of the beamrider type.

2. Description of the Prior Art

A beamrider guidance system functions to maintain missile line of flight in a desired direction. Such systems are most readily applied to short range missile guidance problems and have found particular applications in surface to surface (primarily anti-tank) and surface to air (primarily short range air defense) missions.

A beamrider system generally includes a transmitting section and receiving section, with the receiving section being located on board the missile. In operation, an observer locates a target and projects a beam of electromagnetic radiation from the transmitter to the target. The beam of electromagnetic radiation may be viewed as a volume of radiation forming a guidance corridor to the target which, if followed by the missile, will cause it to strike at the desired location. To assure missile impact on the target, it is necessary for the missile, launched into the beam, to have means for sensing its position within the radiated beam and for controlling its velocity vector to be closely aligned with the beam axis during the flight.

This task may be accomplished by spatially modulating the beam at the transmitter, which modulation is detected and decoded at the missile receiver. The decoded modulation may then provide on board electronics with data indicative of missile position relative to the beam axis. The position data may be used to generate error signals for use by missile guidance devices to steer the missile along the beam axis. More specifically, spatial modulation of the guidance beam results in the formation of an illumination pattern over a cross section of the beam. The illumination pattern divides the beam into a series of resolution elements, with each resolution element bearing a unique signature by reason of its modulation. The missile locates itself relative to the beam axis by detecting the modulation from the resolution element in line with its receiver.

It is known to spatially modulate the electromagnetic radiation beam of a beamrider guidance system in amplitude or frequency. Basic encoding mechanisms include analog AM, digital AM and analog FM modulation. In my copending U.S. patent application Ser. No. 7,751, now U.S. Pat. No. 4,299,360, I disclose an encoding technique which is referred to as digital FM encoding. Examples of other known beam modulation techniques can be found in Menke U.S. Pat. No. 3,690,594, issued Sep. 12, 1972; Miller, Jr., et al U.S. Pat. No. 3,782,667, issued Jan. 1, 1974; MacLusky U.S. Pat. No. 3,501,113, issued Mar. 17, 1970; and Hawes U.S. Pat. No. 3,255,984, Hawes, issued Jun. 14, 1966. In addition, Esker, et al U.S. Pat. No. 4,014,482, teaches pulsed laser spatially modulated beam and Glenn U.S. Pat. No. 4,174,818 shows a digital AM dependent on the amplitude of transmitted pulses.

Amplitude modulation techniques for beamrider guidance systems are exemplified by the aforementioned patent to Hawes and in an embodiment of the beamrider guidance system disclosed in the aforementioned Miller, Jr., et al patent. A beamrider guidance system which uses amplitude modulation techniques, be it analog AM or digital AM, suffers from amplitude fluctuations caused by both natural atmospheric scintillations and pertubations caused by missile wake and plume.

Known beamrider guidance systems using analog frequency modulation techniques have overcome problems associated with amplitude modulated guidance systems. However, these frequency modulation systems are susceptible to noise problems, making frequency discrimination oftentimes difficult. An additional problem with frequency modulation type beam guidance systems are that they are complex. They often require multiple radiation sources to provide a beam having a frequency coded illumination pattern over its cross section, as well as mechanically complicated rotating conical scanners to cause nutation of the transmitted beam which allows a single detector at the missile carried receiver to properly locate the missile relative to the beam axis. A better understanding of these complex frequency modulation guidance systems will be had upon review of the systems described in the aforementioned Miller, Jr., et al and Menke patents. The Esker, et al patent describes a missile directing system utilizing a continuously variable frequency code.

In a conventional frequency modulation technique for spatially encoding a cross section of a guidance beam of a beamrider system, such as that illustrated in the aforementioned Miller, Jr., et al patent, the guidance beam is frequency divided into four quadrants by using four radiation sources, each of a different frequency. The modulated radiation from the four sources are confined into a single beam having the desired spatial modulation by directing the radiation from the four radiation sources through light pipes to a light pipe common junction. The combined radiation is transmitted to nutation projection optics for transmitting the beam to the target.

The target, which may be a missile, is provided with a single detector and cooperating receiving circuitry designed to calculate the time during which each modulation frequency is received at the missile detector during a beam nutation cycle. The missile is properly aligned to the beam axis when the detector receives each frequency for the same period of time during a single nutation cycle. The above described system may be termed an analog frequency modulation beam guidance system.

Another technique for providing analog frequency modulation to a guidance beam of a beamrider guidance system is illustrated in the aforementioned Menke patent. Menke develops frequency modulation of a guidance beam by nutating a rotating disc divided into a number of radiation transmitting pie-shaped sections and a like number of alternately arranged radiation opaque pie-shaped sectors. The sectors are shaped in the described manner so that the width of each sector at a point close to the disc center is less than the sector width at the disc perimeter. The disc is rotated in the path of a guidance beam thereby imparting frequency modulation to the beam. More specifically, the rotating disc functions to chop the guidance beam such that the rotating disc projects an image pattern across the beam cross section, which pattern may be visualized as a series of different frequency divisions extending across the beam cross section. When the rotating disc is nutated, a single detector only is required for locating the missile relative to the beam axis.

The present invention is directed to an improved beamrider guidance system using phase modulation techniques for spatially encoding the guidance beam. As will become evident from a reading of a description of the invention set out hereinafter, the improved guidance system which uses digital phase modulation encoding eliminates the complexity of known FM type beam guidance systems and represents an improvement over the digital frequency modulation type guidance system of my above referenced co-pending patent application.

The novel phase modulation encoding may be implemented with fewer components than my frequency modulation encoding system and has been found to have about 3 dB improvement in signal to noise ratio.

SUMMARY OF THE INVENTION

It is a primary object of the present invention to provide a digital phase modulation technique for beamrider type missile guidance systems.

It is a further object of this invention to combine digital encoding concepts with phase modulation techniques for spatially encoding a guidance beam of a beamrider guidance system.

A still further object of the present invention is to provide an electromagnetic radiation beam guidance system which spatially encodes a guidance beam cross section to develop a large plurality of resolution elements, each resolution element being uniquely designated by a digital code effected by phase modulating the radiation in each resolution element according to a different digital word.

These and other objects as set out hereinafter are accomplished by an electromagnetic radiation beam guidance system which includes a beam transmitting apparatus having one or more encoding masks. The encoding masks are divided into a plurality of bit areas, with each bit area being comprised of cyclically recurring, spaced apart bands which are effective to vary a detectable beam characteristic. For example, the bands may take the form of a multiplicity of equal width transmitting regions with the areas between the bands being opaque to the radiation. The bands are spaced from each other by a preselected distance, with the distance from the leading edge of a band to the leading edge of the next succeeding band being equal to twice the width of a band and defined herein as a bit cycle. Means are provided for moving the encoding mask through the guidance beam whereby the beam is interrupted at a frequency determined by the spacings between the bands of the bit areas. That is, the interruption frequency is determined by the dimensions of the bit cycles. Discrete phase modulation of the interruption frequency is produced by shifting the bands of the bit areas by the width of the band, representing a 180° phase shift.

For example, one bit area may have a set of cyclic bits formed from alternating transparent and opaque bands representing a 0° phase reference for the interruption frequency f. Another bit area may have upper and lower halves in which the upper half comprises a 0° phase set of bit cycles and the lower half has opaque bands immediately below the transparent bands of the upper half and transparent bands immediately below the opaque bands of the upper half. Thus, the modulation frequency produced by the lower half of the bit area will be 180° out of phase with that of the upper half.

To develop orthogonal, such as vertical and horizontal, positional information, two encoding masks are used. To provide vertical position information, one encoding mask is divided into a plurality of rows, the rows defining vertical resolution elements. Each row is comprised of a plurality of bit areas of sufficient number to uniquely designate each of the resolution elements. Specifically, N+1 bit areas will uniquely define $2^N$ resolution elements where one of the bits acts as a reference to define the phase. For example, if each resolution element is defined by five bit areas, a reference and four information bits, then sixteen resolution elements can be uniquely designated.

For a vertical position encoding mask, each bit area may be defined by vertically disposed pattern of cyclically recurring, vertically oriented light transmitting bands with the bands within each pattern being spaced from each other in a horizontal direction by a predetermined distance to produce either a 0° or 180° phase relationship. The given phase defines a logic level. As previously mentioned, the distance between the leading edge of a light transmitting band and the leading edge of the succeeding band is termed herein a bit cycle. Thus, each pattern is comprised of a plurality of bit cycles.

In a two logic level system, each active bit area except the reference will have at least two rows of bit cycles, with the phase of the bit cycle of one row being 180° from that of the other row. That is, each bit area will have at least two patterns of cyclically recurring bands, with the adjacent bands within each pattern having either a 0° or 180° phase relationship to the reference. One position of a light transmitting band followed by an equal width opaque band will represent the reference or 0° and the reverse of such position will represent a 180° phase shift. The 0° phase may represent a logic ZERO (0) and the 180° phase may represent a logic ONE (1). As the vertical position encoding mask is moved through the guidance beam, the beam radiation is chopped at phases determined by the bit cycle positions, that is, the phase of the transparent and opaque bands of the bit areas, thereby defining resolution elements. Each bit area, as it moves through the beam, can simultaneously generate a plurality of spaced apart bits, each bit being one bit of a digital word defining a resolution element. Thus, radiation passing through a resolution element defined by the bit signature 0010 will be chopped first at the 0° phase of the reference then at the 0° phase as the first information bit area of the encoding mask passes through the beam, then at the 0° phase while the second information bit area passes through the beam, then at the 180° phase while the third information bit area of the resolution element passes through the beam, and finally, at the 0° phase while the fourth information bit area of the resolution element passes through the beam. By providing each bit area with several spaced apart sets of cyclic recurring bands, several resolution elements are simultaneously identified.

The missile receiver detects the phase modulated frequency which defines the resolution element which is in the line of sight to the missile detector and converts this information into a digital code for use in locating the missile relative to the beam axis and for initiating correction guidance when necessary.

The horizontal position encoding mask, like the vertical position encoding mask, defines a plurality of resolution elements, through the use of a plurality of bit areas. To develop horizontal position information, the resolution elements appear as a series of columns defined by successively passing each bit area vertically through the radiation beam. Each bit area carries patterns of cyclically recurring horizontally oriented beam modulating bands positioned to define a modulation phase.

The horizontal position encoding mask is moved vertically through the guidance beam to chop the beam at rates and phases determined by the band spacings and phases of the bit areas.

The vertical and horizontal position encoding masks are moved, one at a time, through the guidance beam to provide the missile guidance equipment with vertical and horizontal data relative to the beam axis. Thus, I have provided a spatial encoder for establishing the position of a receiver within a beam of electromagnetic energy by providing digital, orthogonal position information via phase modulation of the electromagnetic energy.

DETAILED DESCRIPTION OF THE PREFERRED EMBODIMENT

Figure 1:
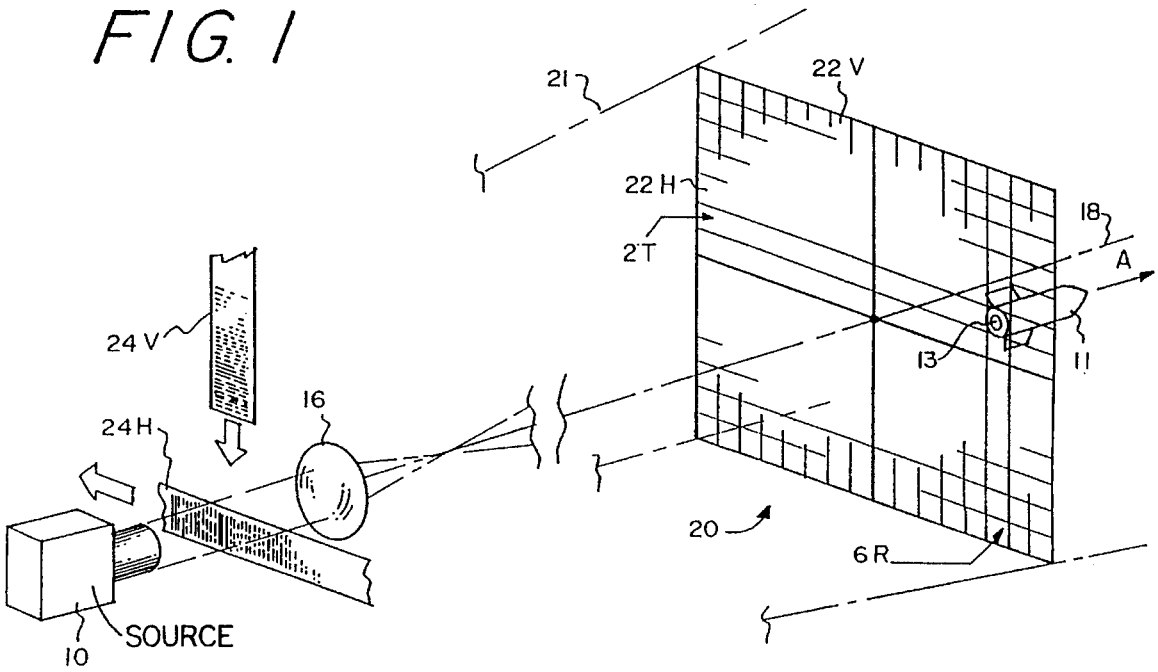
FIG. 1 is a simplified diagram of radiation source and moving masks for producing a spatially encoded electromagnetic beam in accordance with the invention, a representation of a cross section of the beam having the image pattern thereby produced, and a missile in flight off of the center line of the beam.

The subject invention may be better understood by referring to FIG. 1 which illustrates the inventive concept. This figure illustrates a missile 11, with a detector 13 at its aft end, flying in the direction A in a beam of electromagnetic radiation 21 emitted from a source 10 and passing through a projection lens 16. The beam has a central axis 18. A cross section 20 of the radiation beam is shown having an image pattern comprised of a series of horizontally and vertically arrayed resolution elements 22H, 22V defining coordinates of the position of missile 11. The image pattern may be formed by passing encoding mask 24H horizontally through the beam and encoding mask 24V through the beam vertically.

That is, considering that encoding mask 24V is moving in a vertical plane, and the line of sight of the viewer is in a horizontal plane, the cross section 20 of the radiating beam is shown having an image pattern comprising a series of horizontally disposed resolution elements 22H arrayed in a vertical plane and defining an azimuth position with respect to the beam axis. Similarly, mask 24H produces a series of orthogonal vertically disposed resolution elements 22V, which in combination with the horizontal elements 22H define a location in the plane of cross section 20.

In my preferred embodiment, I have used a curved encoding mask having bit areas or frames comprised of spaced apart patterns of cyclically recurring bands of radiation transmitting regions, the spacing between adjacent bands being radiation blocking. However, my invention is not to be construed as being limited to the specific mask configuration illustrated. More generally, my invention contemplates a mask having a plurality of frames defined by spaced apart sets of cyclically recurring regions effective to alter a detectable parameter or characteristic of the radiation beam. For example, frames may be comprised of sets of cyclically recurring wavelength filters. The mask may be formed into any convenient shape such as elongate strips as illustrated in FIGS. 1 and 2 or into curved strips as later described.

Even more broadly, my invention involves spatially encoding a beam of radiation by interrupting the beam with phase modulated signals in accordance with a digital code. The modulation technique operates to divide the beam cross section into resolution elements each identified by a different digital word. Each bit of a digital word may be identified by a phase of a selected frequency. A resolution element is given its unique digital signature by varying the detectable parameter of the beam as a function of time by the phase of the interruption frequency thereby defining the bits of the digital word designating the resolution element. Instead of using an encoding mask, a plurality of radiation sources may be used, each corresponding to a different resolution element. The sources may be phase modulated in accordance with the digital word identifying the resolution element with which the source is associated, to provide the resolution element with its detectable signature.

Figure 2:
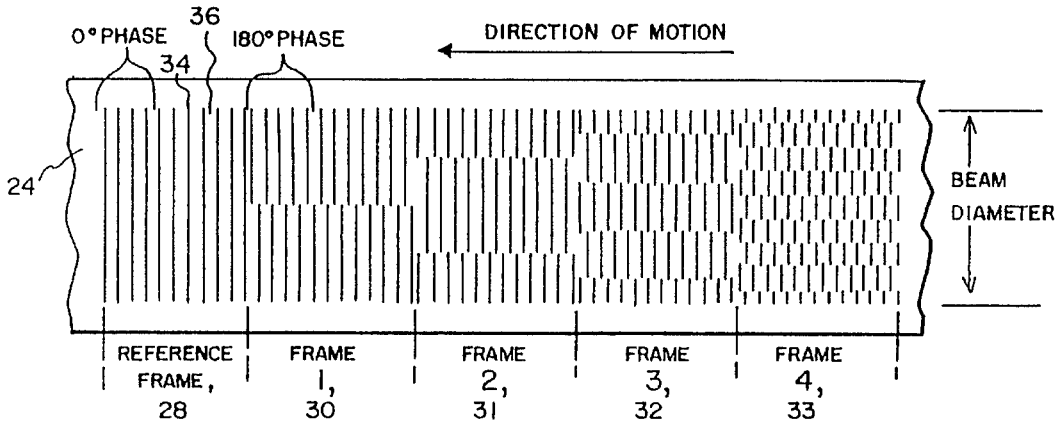
FIG. 2 illustrates an encoding mask for the digital phase encoding of a radiation beam in accordance with the teaching of the invention, the mask being configured to develop either vertically disposed or horizontally disposed resolution elements across a beam cross section.

Returning to my preferred embodiment, which makes use of an encoding mask, FIG. 2 illustrates in greater detail a typical encoding mask usable with my invention. The encoding mask 24 is divided into a series of five frames 28, 30, 31, 32 and 33 with each frame including one or more sets of vertically disposed radiation transmitting bands 34 separated by equal width opaque bands 36.

Figure 3:
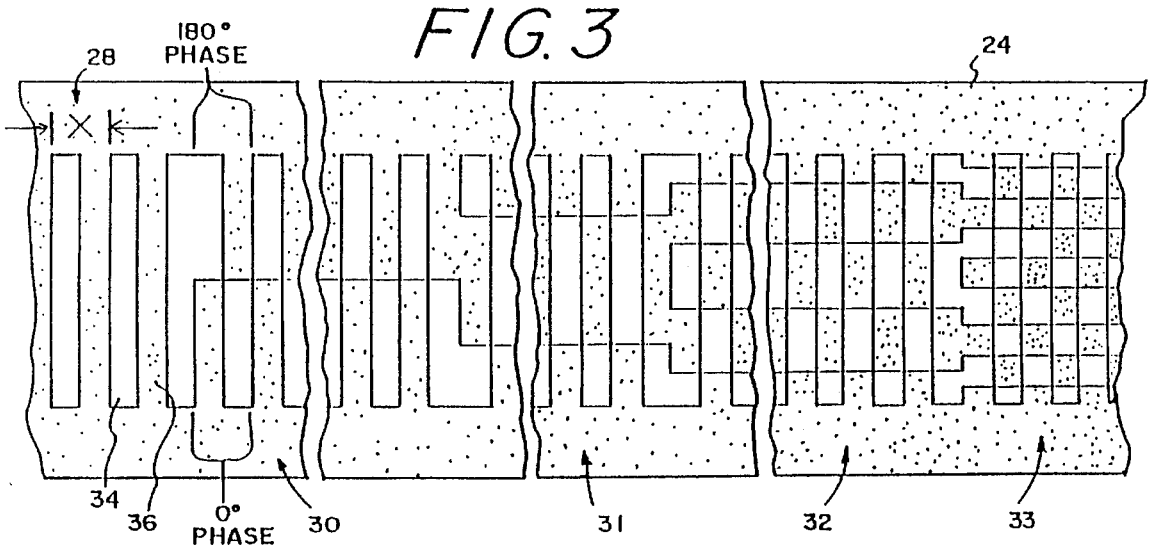
FIG. 3 illustrates examples of masks used in order to produce a modulation frequency of two phases utilized in the position code, and several bit details for the frames of the mask of FIG. 2.

FIG. 3 represents an enlargement to a different scale of typical detail of portions of mask 24 in FIG. 2, with it to be noted that distance X in FIG. 3 is defined as a bit cycle.

The bit cycle dimension, that is, the spacing between the radiation transmitting bands 34, is pre-selected to be proportional to a predetermined frequency. As the encoding mask is moved through the beam at a constant rate, each frame, one at a time, will successively pass through the beam causing it to be chopped at frequencies determined by the spacing between the radiation transmitting bands of the band sets in registration with the beam. More specifically, as reference frame 28 moves through the beam, the entire beam is chopped at a frequency F at a reference phase of 0°. When frame 1 (30) passes through the beam, the top half of the beam is chopped at frequency F at 180° phase while the bottom half is chopped at frequency F at 0° phase. As the mask 24 continues to move through the beam, frame 2 moves into registration with the beam. The top quarter and bottom quarter of frame 2 (31) contain radiation emitting bands spaced from each other to produce a 180° phase while the middle half of frame 2 bears radiation transmitting bands spaced to produce a 0° phase. Thus, as frame 2 moves through the beam, the top and bottom quarters of the beam cross section are chopped at the frequency F with 180° phase while the central portion of the beam cross section is chopped at the frequency F with 0° phase. As will be apparent, the use of a single information frame 1 (30) divides the beam cross section into two resolution elements. When an encoding mask is provided with two information frames 30 and 31, the beam cross section may be divided into four resolution elements. In the latter case the top most resolution element is identified by the digital phase code 180°, 180°, the following resolution element by the digital phase code 180°, 0°, the third resolution element by phase code 0°, 0° and the lowest most resolution element by the digital phase code 0°, 180°.

The number of resolution elements into which a beam cross section can be divided is dependent upon the number of information frames utilized. Generally, the number of resolution elements which may be realized is equal to $2^N$ where N equals the number of information frames. FIG. 2 illustrates an encoding mask divided into a reference frame 28 and 4 information frames, 30, 31, 32 and 33 which provides 16 resolution areas. It should be noted at this time that two encoding masks 24 of FIG. 2 may be used to provide both horizontally and vertically disposed resolution areas which are used to provide the missile 11 of FIG. 1 with elevation data relative to the beam axis 18. Thus, when mask 24H is moved through the beam from source 10, the vertical resolution elements 22V are produced, and an identical mask 24V, moved vertically through the beam generates horizontal resolution elements 22H.

FIG. 3 represents examples of the bit details for the frames 28, 30, 31, 32 and 33 of FIG. 2. Each frame will contain a plurality of the bit details illustrated. For example, each frame may include a bit detail repeated 16 times. That is to say, each bit may, of course, include a greater or lesser number of bit cycles as circumstances require, I have found that frames containing 16 bit cycles each will be adequate to define the digital signature of a resolution element.

The bit detail of reference frame 28 shows the dimension X, as previously mentioned, defined as a bit cycle for frequency F at the 0° phase reference. The bit cycle dimensions X defining frequency F will be the same for each frame of mask 24. The horizontal resolution mask 24V may be configured with bit details identical to that used in mask 24H. It is also possible to use different phase sets for the two orthogonal directions, i.e, elevation and azimuth. Phase 0° and 180° can be used to designate vertical position resolution elements while phase 90° and 270° may be used to designate horizontal position resolution elements. Alternatively, a frequency $F_1$ may be used for vertical position resolution elements and a different frequency $F_2$ used to designate horizontal resolution elements. Either approach allows the receiver to easily differentiate between elevation and azimuth information. Phase 90° and 270° may be generated using the same bit details illustrated in FIG. 3 with only the 4 active frame band positions relative to the reference frame being shifted.

As should now be apparent, a preferred embodiment of this invention utilizes one or more chopper masks which serve to produce digital phase modulation as they are caused to move through the cross section of a projection beam. Preferably, two chopper masks which move sequentially through the cross section of the beam are used. One of such masks should contain position information which is orthogonal to the position information that is contained on the other mask and both sets of information are orthogonal to the beam axis.

My invention is not limited to operate with a particular electromagnetic beam generating apparatus and any of various conventional beam generating devices may be employed. The beam source may be, for example, a light source such as a laser combined with a suitable projection lens. The encoding mask would be located between the source and the lens to chop the light prior to its projection. A more detailed description of a suitable beam generating apparatus is to be set out hereinafter.

Missile 11 is provided with receiving equipment which includes a detector 13 responsive to the radiation emitted by the source 10. While the order in which the cross section is encoded is generally immaterial, it will be assumed that the beam is first encoded into vertical position resolution elements and then into horizontal position resolution elements. Thus, the detector first receives a digital phase code corresponding to the vertical position resolution element 22V which is in its line of sight, for example, 6R in FIG. 1. This digital phase code may be converted into a position code for processing by the on-board guidance elevation correction circuitry. Next, the detector receives a digital phase code for horizontal resolution element 22H; for example, 2T, which is converted to control the azimuth correction system of the missile 11.

Figure 4:
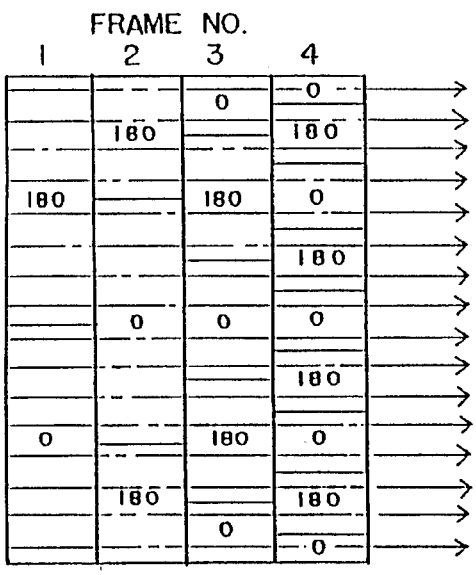
FIG. 4 is a table of digital code words corresponding to designated vertically or horizontally disposed resolution elements.

It has been determined that excellent guidance information can be developed using a four information bit code which defines 16 resolution elements in each of two orthogonal directions. Such a four bit encoding mask is illustrated by frames 1 through 4 in FIG. 2. FIG. 4 sets out the guidance codes for each of the 16 resolution elements defined by the mask of FIG. 2. The frame chart illustrates the phase codes for the four information frames as the mask completes a scan through the beam. Assigning a logic ZERO to a 0° phase and a logic ONE to a 180° phase, the top scan as indicated by the dashed scan arrow, generates the four bit digital word 1100. For the vertical, or elevation position this code denotes a position 8 resolution elements above the beam center line, indicated by 8T. For the horizontal, or azimuth position, the code designates position 8R or 8 elements to the right of the center line. The remainder of elements are identified by the codes shown. Positions labeled T and B correspond to top and bottom positions, respectively, with regard to the beam axis. The guidance axis relative to elevation is at the boundary between the positions 1T and 1B in FIG. 4.

For purposes of illustration of the missile guidance operation in accordance with this implementation of my invention, assume that detector 13 of FIG. 1 is in line with the second resolution element above the center line (2T) and the sixth resolution element to the right of the center line (6R). From FIG. 4 it may be seen that the detector 13 will receive the phase codes 1001, 1111 in sequence which will be decoded into logic levels. The code words are processed by the missile guidance correction circuitry to relocate the missile towards the beam axis as will be described in more detail hereinafter.

Figure 6:
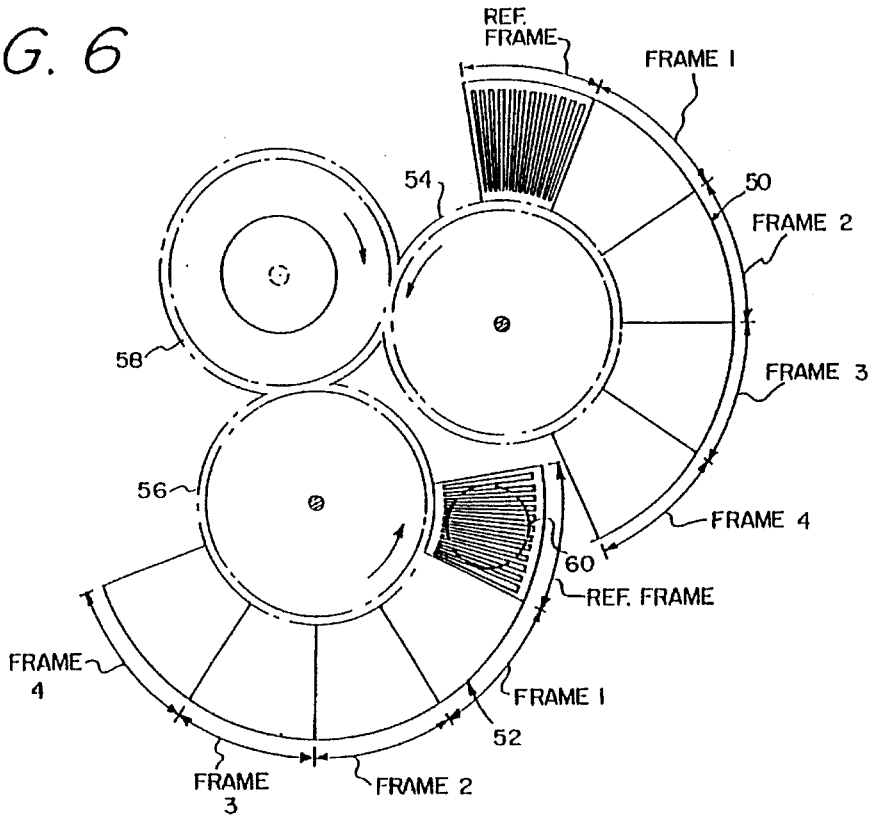
FIG. 6 shows a preferred embodiment of the encoding mask of my invention, which embodiment is an encoder wheel.

In my preferred embodiment, the encoding masks are implemented by an encoder wheel as illustrated in FIG. 6. The encoder wheel is comprised of a vertical resolution encoder wheel segment 50, and a horizontal encoder wheel segment 52. Each encoder segment is attached by any suitable means to a respective drive gear 54, 56. The vertical drive gear 54 and horizontal drive gear 56 are preferably driven by a single motor. To this end, main drive gear 58, coupled to the motor (not shown), engages the vertical and horizontal drive gears 54, 56. The encoder segments 50, 52 each occupy less than 180°. In this way they may be made to rotate, preferably one at a time, through the electromagnetic beam 60, with there being no overlapping of the segments 50, 52 in the area of the beam 60. Rotation in this instance may be in the direction of the arrows appearing on members 50 and 52 in FIG. 6.

The bit details of the frames of the encoder segments 50, 52 may take the form shown in FIG. 3 but in radial form. The bit details for the frames of the vertical and horizontal encoder segments 50, 52 are only partially illustrated for clarity. It is again noted that if desired, the bit cycle dimensions of the vertical encoder segment may be different from that of the horizontal encoder segment.

The sequences of phases generated by the encoder wheels of FIG. 6 corresponds to the table in FIG. 4, with the positions labeled R and L corresponding to positions to the right and left of the beam axis and positions T and B representing positions at the top and bottom of the beam axis. Resolution element 8L and 8B are closest to the wheel hub while resolution element 8R and 8T are closest to the outer edge of the wheel. It is to be understood that the frequency sequences given in the table of FIG. 4 are for illustration purposes only. It will be obvious to one skilled in the art that other alternative codes could be devised using the basic concept of a series of discrete phases to digitally encode a guidance beam. Simple alternatives include exchanging phases 0° and 180° in all bit areas or reversing the order of the resolution elements. It is also possible to use multiple phases for coding; however, the use of 0° and 180° phases provide the maximum discrimination between a logic ONE and a logic ZERO. Completely unrelated codes are also possible.

I have found that garbling tends to occur and net energy transmission is reduced if the information appearing on one encoder segment or track is transmitted simultaneously with the information appearing on the other encoder segment or track, so I prefer for each of the wheels 50 and 52 to extend slightly less than 180°, and to rotate without their information containing portions contacting each other. It is also preferred for one wheel to present all of its information, and then for the other wheel to present its information, without interleaving taking place, although this latter could be resorted to if desired. I also prefer for each bit of information to be transmitted from the precise focal plane of the associated projection optics, and this, of course, is simplified by utilizing the arrangement shown in FIG. 6 wherein the wheels 50 and 52 rotate in a timed, non-interfering relationship with each other.

Figure 7:
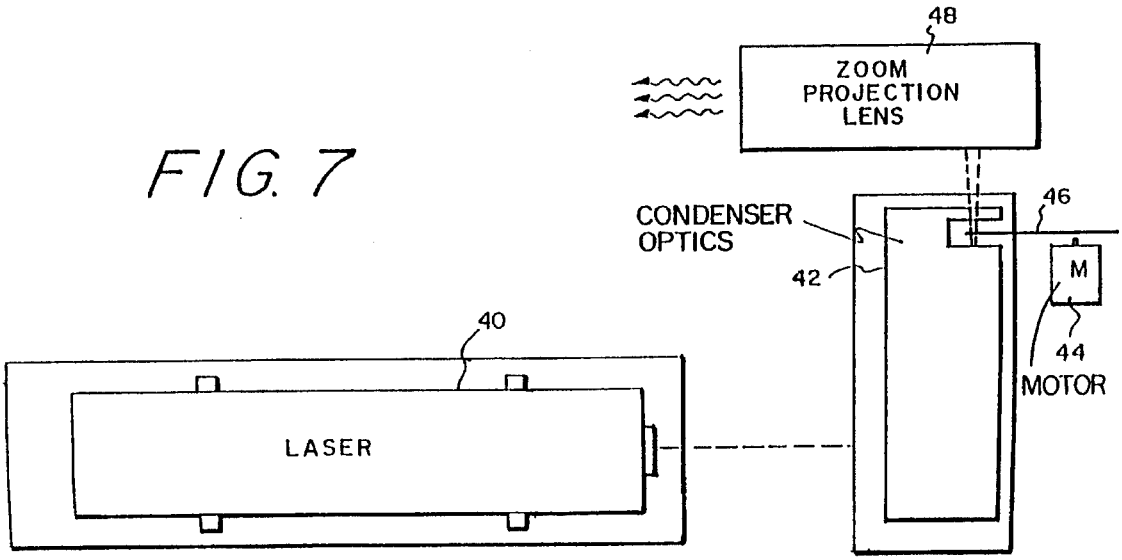
FIG. 7 illustrates a preferred embodiment of the equipment for projecting a beam of electromagnetic radiation encoded in accordance with the teachings of the present invention.

FIG. 7 illustrates a preferred embodiment of the beam forming and encoding apparatus required for a digital phase modulation code in accordance with the teachings of the present invention. One component is the source of electromagnetic radiation which is illustrated in FIG. 7 as a laser source 40. It is understood that in the most general embodiment of the subject invention a laser is not required and that any source of electromagnetic radiation having the desired wavelength and intensity could be used. For example, it would be possible to implement the system of the present invention with a Xenon arc lamp as the source of radiation. The major reason for choosing a laser as the source is the monochromatic nature of the laser radiation. This allows all the optics to be designed with no color correction and allows the receiver to incorporate a very narrow bandwidth spectral filter for discriminating against spurious broad band signals caused by the sun and by the rocket motor plume if the system is employed as a missile guidance technique. Additionally, the inventive technique is not limited to being used with a single laser type but may be employed with any laser that produces sufficient power for the desired application. My preferred embodiment utilizes a $CO_2$ laser because the $CO_2$ laser exhibits superior transmission through atmospheric conditions such as haze and smoke. An example of a typical $CO_2$ laser that could be utilized with this type of guidance technique is the commercially available model 941 made by Spectra-Physics.

A second major component of the beam generating equipment is the condenser optics 42. The function of this set of optics is to take the source of radiation and form it into the proper size and shape to illuminate the encoder 46. With a laser source, the condenser optics can take the form of a beam expander which takes a circularly symmetrical laser beam and increases its diameter to a size sufficient to illuminate the encoder. Beam expanders of this type are commercially available. For example, a model BECZ10.6 C1.4:10-D5 made by II-VI, Inc. could be utilized. Other forms of condenser optics known in the art could also be used.

As illustrated in FIG. 7, a motor 44 drives an encoder 46, which may correspond to the encoding wheels of FIG. 6, through the expanded laser beam. The laser beam then enters the projection optics 48. The projection optics functions to relay the image of the encoder to the plane of the receiver. In a missile system, the distance to the receiver located in the missile is constantly increasing during missile flight. It is desirable for the image in the receiver plane to remain a constant size. The missile then can have a constant gain for a given error and similar accuracy at any range. To maintain the image size constant, the projection optics may include a motor driven zoom lens. The focal length of the zoom lens could be programmed to increase at a rate consistent with missile velocity, and therefore, the beam diameter remains essentially constant at the missile. With such a system, the zoom ratio would be determined by the range over which the system must be used. For example, if the guidance must maintain accuracy between 1 km and 5 km then a 5:1 zoom ratio is required. The focal length and aperture size of the lens would be selected for each application. It should be obvious to those skilled in the art that the specific projection system illustrated is but one of any number of projection systems which may be used without departing from the spirit or scope of my invention. The specific projection scheme will depend upon the specific application.

When the beam of electromagnetic radiation is in a form of a laser beam, the receiver components of the missile are similar to those used with any laser beamrider system operating at a given wavelength. The only exception is the decoder electronics which must be tailored to operate with the system's particular code.

Figure 5:
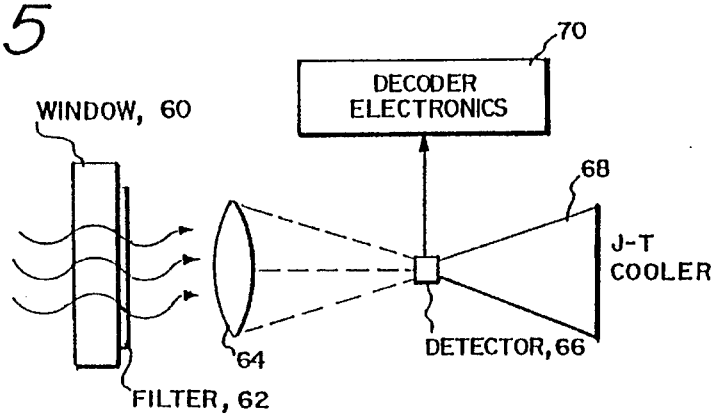
FIG. 5 is a diagramatic representation of receiver equipment which can detect and decode a beam of electromagnetic radiation encoded according to the teachings of the invention.

In general, as illustrated in FIG. 5, the receiver optical system consists of a receiver window 60 with a narrow band optical filter 62 deposited on its rear surface. Behind the receiver window is a collector lens 64 and a suitable detector 66 such as a HgCdTe detector. The detector may be mounted on a Joule-Thomson cooler 68. The cooler 68 is generally used when the received radiation is in the long wave infrared region. However, the cooler would not be necessary if the received radiation is in the near infrared region.

Both the window and the lens may be made of a germanium if the received radiation is in the long wave infrared region and all surfaces except that having the narrow band pass filter are anti-reflection coated for the desired wavelength. The lens 64 is preferably set at a shorter distance than the on axis focal length. This setting spreads the radiation over a larger area to avoid the effects of point-to-point changes in detector response. It also allows more of the off axis rays to be intercepted by the detector and avoids the requirement for precision focus of the lens on the detector surface.

The signal from the detector is sent to the decoder electronics 70 which may include a pre-amplifier and post-amplifier stage. The pre-amplifier may advantageously include a narrow band filter centered at F for rejecting spurious signals and noise, thereby increasing the system signal to noise ratio. Depending upon the application, the post-amplifier can be automatically gain controlled to raise the signal level above a clipper level. The clipper is not intrinsic to the system, but it does remove amplitude scintillation noise. The ability to amplify and clip is an advantage of phase modulation and frequency modulation systems and is not an option available in amplitude modulation systems. After amplification, the decoder electronics processes the detected signals. The encoder 46 can be synchronized with the missile receiver system prior to launch to define the vertical and horizontal planes. During flight, the reference frame is detected first and serves to establish the 0° phase reference. The next four phase signals are detected by a pair of phase detectors thereby producing the 4-bit word representative of the location of the missile in one coordinate. The detected code word is input to a simple digital logic which determines the receiver position for that word with respect to the beam center. The output of this logic can be either a voltage proportional to position which can be displayed or sent to an auto-pilot for guidance or a digital output for use with digital signal responsive guidance equipment. The output of the receiving system then produces the 4-bit word for the other coordinate which is similarly processed and utilized in accordance with the system.

While my invention has been disclosed with reference to a preferred embodiment, it is to be understood that it should not be construed to be limited to the specific embodiment described. Various modifications may be made to the details of the described embodiment without departing from the spirit and scope of my invention. For example, and without limitation, the illustrated mask and bit detail configurations are exemplary only and may be configured in any other suitable way.

I am not to be limited to the use of masks containing appropriate combinations of clear and opaque regions responsible for producing the frequency modulation information to which the missile receiver is responsive, and for example it may be practical instead of masks to utilize a number of GaAs diode lasers, and to assign one of such lasers to each resolution element. For example, an array of say 256 GaAs lasers could be utilized, with each laser modulated to produce the selected digital phase modulated code by changing its excitation current. A digital switching network would be used to switch the current to the lasers in such a way as to produce modulation formats analogous to, if not identical to, the chopper disc modulation formats. It is also not necessary for the radiation modulation to change the radiation intensity as is done by the clear and opaque regions of a mask. Alternately, other radiation parameters such as the spectral content or the polarization may be modulated to convey the phase information required for the spatial code.

I claim:

1. An encoding mask for use in conjunction with an electromagnetic beam of radiation for spatially encoding the beam as the mask is moved through the beam at a constant, predetermined speed to thereby facilitate the locating of an object in space, comprising a surface having a series of adjacent regions defining frames, each of said regions being defined by one or more sets of spaced apart cyclically recurring bands effective to vary a detectable beam parameter, the spacing between adjacent bands of a set being preselected to produce a predetermined beam modulation frequency as the surface is moved through the beam, the adjacent bands of one set of bands within a frame being shifted in position from the adjacent bands of at least one other set of bands within the same frame to thereby spatially modulate the beam at two phases of said frequency, at least, as a frame is moved through the beam.

2. In the encoding mask as set out in claim 1 wherein said bands alter the intensity of the radiation passing therethrough relative to the intensity of the radiation passing through the regions between adjacent bands.

3. In the encoding mask as set out in claim 1 wherein said bands alter the wavelength of radiation passing therethrough relative to the radiation pass band of the regions between adjacent bands.

4. In the encoding mask as set out in claim 1 wherein said bands alter the polarization of radiation passing therethrough relative to the radiation passing through the regions between adjacent bands.

5. In the encoding mask as set out in claim 1 wherein said surface is generally rectangularly shaped with a plurality of frames being sequentially positioned along the length of the surface.

6. In the encoding mask as set out in claim 1 wherein said surface is curved, said frames being located about the surface circumference, with the different sets of spaced apart radiation transmitting bands being radially disposed within each frame.

7. A system for encoding a beam of electromagnetic radiation in a manner whereby the beam cross section is spatially encoded to define resolution elements which are detectable by an object to locate itself within the beam, comprising:

a source of electromagnetic radiation;

projection means for producing a beam of radiation in response to radiation from said source; and means for spatially modulating said beam by the use of a frequency having at least two fixed, discrete phases so as to convey a sequence of digital codes to produce an array of digital words which resolve positions within the beam into unique discrete locations.

8. In the encoding system according to claim 7 wherein said spatial modulation means includes means for phase modulating the beam of radiation in accordance with said digital codes whereby said beam is spatially encoded into resolution elements, each of which is identified by a different one of said digital words.

9. In the encoding system according to claim 8 wherein said spatial modulation means includes a plurality of electromagnetic radiation sources and means for phase modulating the radiation intensity of each of said sources in accordance with a digital word to define said spatially separated resolution elements.

10. A system for encoding a beam of electromagnetic radiation in a manner whereby the beam cross section is spatially encoded to define resolution elements which are detectable by an object to locate itself within the beam, comprising:

a source of electromagnetic radiation;

projection means for producing a beam of radiation in response to radiation from said source; and means for spatially modulating said beam in accordance with a digital code, said spatial modulation means including an encoding mask defining at least one frame comprising a plurality of cyclically recurring regions effective to vary a detectable beam parameter, said regions being spaced apart by a distance proportional to a predetermined frequency determined by the rate at which the frame moves through the beam, at least two of said regions in each information frame shifted in position relative to each other, and means for moving said frame of the mask through the beam of radiation at a selected rate to vary the phase of the radiation at said predetermined frequency.

11. In the encoding system according to claim 10 wherein said detectable parameter is beam intensity and said regions are bands of light transmitting areas spaced apart by light blocking areas.

12. In the encoding system according to claim 10 wherein said spatial modulation means includes two encoding masks for modulating the beam in two orthogonal directions.

13. In the encoding system according to claim 10 wherein said encoding mask is a segment of an encoding wheel.

14. In the encoding system according to claim 11 wherein said encoding mask includes a plurality of frames, each frame having at least two special sets of light transmitting bands having equal spacing between the bands of all sets, the position of at least one of said sets in each information frame shifted with respect to at least one other set to thereby simultaneously modulate the beam of radiation at two different phases of said frequency as an information frame of the mask is moved through the beam.

15. In the encoding system according to claim 14 in which said encoding mask further includes a frame having a single set of light transmitting bands having the same spacing as said special sets, said frame modulating the beam of radiation at a 0° phase of said frequency, said two different modulation phases produced by said special sets being 0° and 180°.

16. In the encoding system according to claim 15 in which said modulation from said frame is usable by said object as a phase reference.

17. In the encoding system according to claim 14 wherein said encoding mask includes N frames plus a reference frame, said frames being provided with sets of light transmitting bands to define $2^N$ resolution elements.

18. In the encoding system according to claim 10 wherein said source of electromagnetic radiation is a source of laser energy, and further comprising optic means for sizing the source radiation to uniformly illuminate at least a portion of a frame of said encoding mask and projection means for relaying the encoded radiation as a radiation beam of preselected dimension and intensity.

19. A system for locating an object relative to its position in a beam of electromagnetic radiation and including means for spatially encoding the radiation beam into resolution elements which can be detected by the object to provide it with position information, comprising:

a source of electromagnetic radiation;

projection means for producing a beam of radiation which can be received by the object;

means for spatially modulating said beam by the use of at least two fixed phases of a discrete frequency so as to convey an array of digital words which resolve positions within the beam into unique discrete locations; and receiver means carried by said object for detecting said digital words to provide said object with an indication of its position relative to said resolution elements.

20. In the system as claimed in claim 19 wherein said receiver means includes detector means responsive to the beam radiation, and decoder means responsive to said detector means for decoding the received digital, phase modulation received by the detector means.

21. In the system as claimed in claim 20 wherein said phase modulating means includes an encoding mask having at least one frame for movement through said beam, said frames comprising spaced apart means for simultaneously and cyclically varying a beam characteristic of at least two different phases of said discrete frequency to define at least two resolution elements.

22. In the system as claimed in claim 21 in which said encoding mask further has a first frame for varying a beam characteristic at a single phase of said discrete frequency to serve as a reference phase.

* * * * *